US006006637A

United States Patent [19]

Sanders et al.

[11] Patent Number: 6,006,637

[45] **Date of Patent: *Dec. 28, 1999**

[54] SERVO DRIVEN WATERCUTTER

[75] Inventors: Donald Joseph Sanders, Larsen; Mary Elizabeth Barker, Appleton; Bruce Arthur Owen, Weyauwega; Michael James Collom, Green Bay; John Harland Hise; Brian Lee Griebenow, both of Appleton; Robert Duane Herberg, Hortonville, all of Wis.

[73] Assignee: Kimberly-Clark Worldwide, Inc., Neenah, Wis.

[ * ] Notice: Under 35 U.S.C. 154(b), the term of this patent shall be extended for 326 days.

[21] Appl. No.: 08/529,041

[22] Filed: Sep. 15, 1995

Related U.S. Application Data

[63] Continuation of application No. 08/423,424, Apr. 28, 1995, abandoned.

[51] Int. Cl.[6] ..... B26F 3/00

[52] U.S. Cl. ..... 83/53; 83/177; 83/76.8

[58] Field of Search ..... 83/53, 76.1, 76.6, 83/76.7, 76.8, 76.9, 177

[56] References Cited

U.S. PATENT DOCUMENTS

| | | | |
|---|---|---|---|
| 815,495 | 3/1906 | Waggener . | |
| 2,110,112 | 3/1938 | Rippey | 299/18 |
| 2,942,789 | 6/1960 | Smith | 239/239 |
| 3,526,162 | 5/1968 | Willcox | 83/16 |
| 3,623,667 | 11/1971 | Costa | 239/364 |
| 3,645,453 | 2/1972 | Morgan | 239/237 |
| 3,712,545 | 1/1973 | Felix | 239/233 |
| 3,877,334 | 4/1975 | Gerber | 83/177 X |
| 4,019,686 | 4/1977 | Palma | 239/205 |
| 4,116,097 | 9/1978 | Graham et al. | 83/177 X |
| 4,140,038 | 2/1979 | Higgins | 83/177 |
| 4,266,112 | 5/1981 | Niedermeyer | 219/121 LN |
| 4,328,726 | 5/1982 | Pearl | 83/76.8 X |
| 4,440,345 | 4/1984 | Figwer et al. | 239/214 |
| 4,509,686 | 4/1985 | Larsen | 239/239 |
| 4,567,796 | 2/1986 | Kloehn et al. | 83/177 X |
| 4,594,924 | 6/1986 | Windisch | 83/177 |
| 4,620,466 | 11/1986 | Jumel et al. | 83/53 X |
| 4,735,566 | 4/1988 | Squicciarini | 425/312 |
| 4,787,178 | 11/1988 | Morgan et al. | 51/418 |
| 4,875,254 | 10/1989 | Rudy et al. | 17/61 |
| 4,876,934 | 10/1989 | Fagan et al. | 83/491 |
| 4,903,559 | 2/1990 | Landeck | 83/24 |
| 4,913,044 | 4/1990 | Heath | 99/494 |
| 4,931,140 | 6/1990 | Peltola et al. | 162/193 |
| 4,962,568 | 10/1990 | Rudy et al. | 17/52 |
| 4,966,059 | 10/1990 | Landeck | 83/177 X |

(List continued on next page.)

FOREIGN PATENT DOCUMENTS

| | | | |
|---|---|---|---|
| 514685 | 11/1992 | European Pat. Off. | 83/177 |
| 2 707 545 | 1/1995 | France . | |
| 1 949 583 | 10/1969 | Germany . | |
| 2 121 983 | 1/1984 | United Kingdom . | |
| 94/05158 | 3/1994 | WIPO . | |

*Primary Examiner*—M. Rachuba
*Attorney, Agent, or Firm*—Paul Yee

[57] ABSTRACT

An apparatus for cutting a moving substrate includes a cutter nozzle connected to a movable support. A supplying mechanism provides a cutting fluid to the cutter nozzle at a pressure which provides for a fluid flow rate from the cutter nozzle which is sufficient to cut the substrate in a selected cut pattern. A designating mechanism identifies a plurality of selected article lengths along the substrate, and a transporting mechanism moves the substrate at a predetermined speed along the machine direction during the cutting of the substrate. An actuating servo moves the cutter nozzle along a selected cutting path, and a regulating mechanism controls the actuating servo by employing a selected, electronically stored data set. The data set is configured to move the actuating servo in a selected sequence, and the sequence has a predetermined correspondence with the movement of the substrate to thereby direct the cutter nozzle along the selected cutting path and provide the selected cut pattern on the substrate.

28 Claims, 9 Drawing Sheets

U.S. PATENT DOCUMENTS 5,031,496 7/1991 Lobash et al. ..... 83/107
5,083,487 1/1992 Croteau ..... 83/53 X
5,161,305 11/1992 Yamakawa ..... 29/846
5,199,342 4/1993 Hediger ..... 83/177
5,269,211 12/1993 Flaming ..... 83/39
5,295,425 3/1994 Hediger ..... 83/177
5,330,103 7/1994 Eckstein ..... 239/242
5,339,715 8/1994 Coleman ..... 83/177 X
5,365,816 11/1994 Rudy ..... 83/177

SERVO DRIVEN WATERCUTTER

This is a continuation application of application Ser. No. 08/423,424, filed on Apr. 18, 1995 now abandoned.

FIELD OF THE INVENTION

The present invention relates to a system for directing a fluid onto a moving substrate. More particularly, the present invention relates to an apparatus and method for cutting a web, such as a web which is constructed and arranged for producing an interconnected series of articles.

BACKGROUND OF THE INVENTION

Conventional devices have been employed to direct fluids, such as treatment fluids or processing fluids onto a substrate. For example, conventional cutting devices, such as high pressure water cutters, have been employed to cut the side contours of the components employed in absorbent articles, such as disposable diapers, feminine care products, incontinence products and the like. Such components include, for example, absorbent pads, bodyside liner layers, backsheet layers, and the like. Typically, the mechanisms employed to direct the fluid along the desired patterns or contours have been regulated by devices such as cam boxes, open cams, die cutters and other types of mechanical and electro-mechanical pattern-following systems. Such devices can produce fixed and repeating patterns, but the patterns are not readily modified. To change the cutting pattern In a cam system, for example, it is usually necessary to remove and replace an entire cam box portion of the system. To change the cutting pattern In a die cutter system, it has been necessary to remove and replace the die set if the same repeat length is employed, or to remove and replace the entire die cutter if a different repeat length is desired. In addition, conventional devices, such as those described above, have had difficulty accommodating high speed manufacturing processes which incorporate rapid accelerations and rapid direction changes. During such high speed operations, the rapid accelerations can produce excessively high wear and excessively high stresses. As a result, the manufacturing line is not readily adaptable to produce variations in the desired product, and the manufacturing line can require excessively high maintenance. The stress and wear on the cutting systems can, over time, produce excessive variability in the formation of the desired patterns or contours.

Due to the shortcoming of conventional systems, such as those described above, there has been a need for directing devices that can be rapidly adapted to produce various, different patterns or contours. In addition, there has been a need for systems that have a more consistent operation, are more reliable, produce less variability and are less susceptible to mechanical wear.

BRIEF DESCRIPTION OF THE INVENTION

The present invention can provide an apparatus for directing a fluid in a selected pattern onto a moving substrate. The apparatus includes a nozzle connected to a movable support, and a supplying means for providing the fluid to the nozzle at a pressure which provides for a selected fluid flow rate from the nozzle. A designating means identifies a plurality of selected lengths along the substrate, and a transporting means moves the substrate at a predetermined speed along a machine direction during the directing of fluid onto the substrate. An actuating servo moves the nozzle along a selected delivery path, and a regulating means controls the actuating servo by employing a selected, electronically stored data set. The data set is configured to move the actuating-servo in a selected sequence, and the sequence has a predetermined correspondence with the movement of the substrate to thereby direct the nozzle along the selected delivery path and provide the selected pattern onto the substrate.

The present invention can also provide an apparatus for cutting a moving substrate, wherein the apparatus includes a cutter nozzle connected to a movable support, and a supply means for delivering a cutting fluid to the cutter nozzle. The cutting fluid is delivered at a pressure which provides for a fluid flow rate from the cutter nozzle, and the fluid flow rate is sufficient to cut the substrate in a selected cut pattern. In particular aspects of the invention, a designating means can identify a plurality of selected lengths along the substrate, and the article lengths can define a plurality of article segments which are interconnected along a machine direction of the apparatus. A transporting means moves the substrate at a predetermined speed along the machine direction during the cutting of the substrate, and an actuating servo moves the cutter nozzle along a selected cutting path. In other aspects of the invention, a regulating means can control the actuating servo by employing a selected, electronically stored data set. The data set is configured to move the actuating servo in a selected sequence, and the sequence has a predetermined correspondence with the movement of the substrate to thereby direct the cutter nozzle along the selected cutting path and provide the selected cut pattern on the substrate.

The present invention can further provide a method for directing a fluid in a selected pattern onto a moving substrate. The method includes the steps of providing a nozzle, and supplying a selected fluid to the nozzle at a pressure which provides for a selected fluid flow rate from the nozzle. A plurality of selected article lengths are identified along the substrate, and the substrate is transported to move the article lengths along a machine direction at a predetermined speed during the directing of fluid onto the substrate. A movement of the nozzle is servo actuated along a selected delivery path, and the servo actuating is regulated in accordance with an electronically stored data set. The data set is configured to control the servo actuating step in a selected sequence, and the sequence has a predetermined correspondence with the transporting of the substrate to thereby direct the nozzle along the selected delivery path and provide the selected pattern on the substrate.

The invention can additionally provide a method for cutting a moving substrate, which includes the steps of providing a cutting nozzle and supplying a cutting fluid to the cutter nozzle at a pressure which provides for a fluid flow rate from the cutter nozzle. The fluid flow rate is sufficient to cut the substrate in a selected pattern.

Particular aspects of the method of the invention can be arranged to identify a plurality of selected article lengths along the substrate, and the article lengths can define a plurality of article segments which are interconnected along a machine direction of the method. The substrate is transported to move the article segments along the machine direction at a predetermined speed during the cutting of the substrate, and a movement of the cutter nozzle is servo actuated along a selected cutting path. In further aspects of the method, the servo actuating movement can be regulated in accordance with an electronically stored data set, which is configured to control the servo actuating movement in a selected sequence. The sequence has a predetermined correspondence with the transporting of the substrate to thereby direct the cutter nozzle along the selected cutting path and provide the selected pattern on the substrate.

The various aspects of the present invention can advantageously provide for an easier modification of the selected pattern, such as a selected cut pattern, and can provide for a more flexible manufacturing process. Modifications to the selected patterns can be made at less expense, and the manufacturing line can experience reduced storage and maintenance costs. In addition,.there can be reduced mechanical wear of the components of the fluid-directing system, and the system can provide less variability in the selected patterns. The patterns can be more consistent during the life of the system, and continual, fine-tuning adjustments can be made in the pattern without requiring the purchase and acquisition of expensive components, such as new cam boxes, cams or die cutter sets.

BRIEF DESCRIPTION OF THE DRAWINGS

The present invention will be more fully understood and further advantages will become apparent when reference is made to the following detailed description of the invention and the drawings, in which.

DETAILED DESCRIPTION OF THE INVENTION

Figure 1:
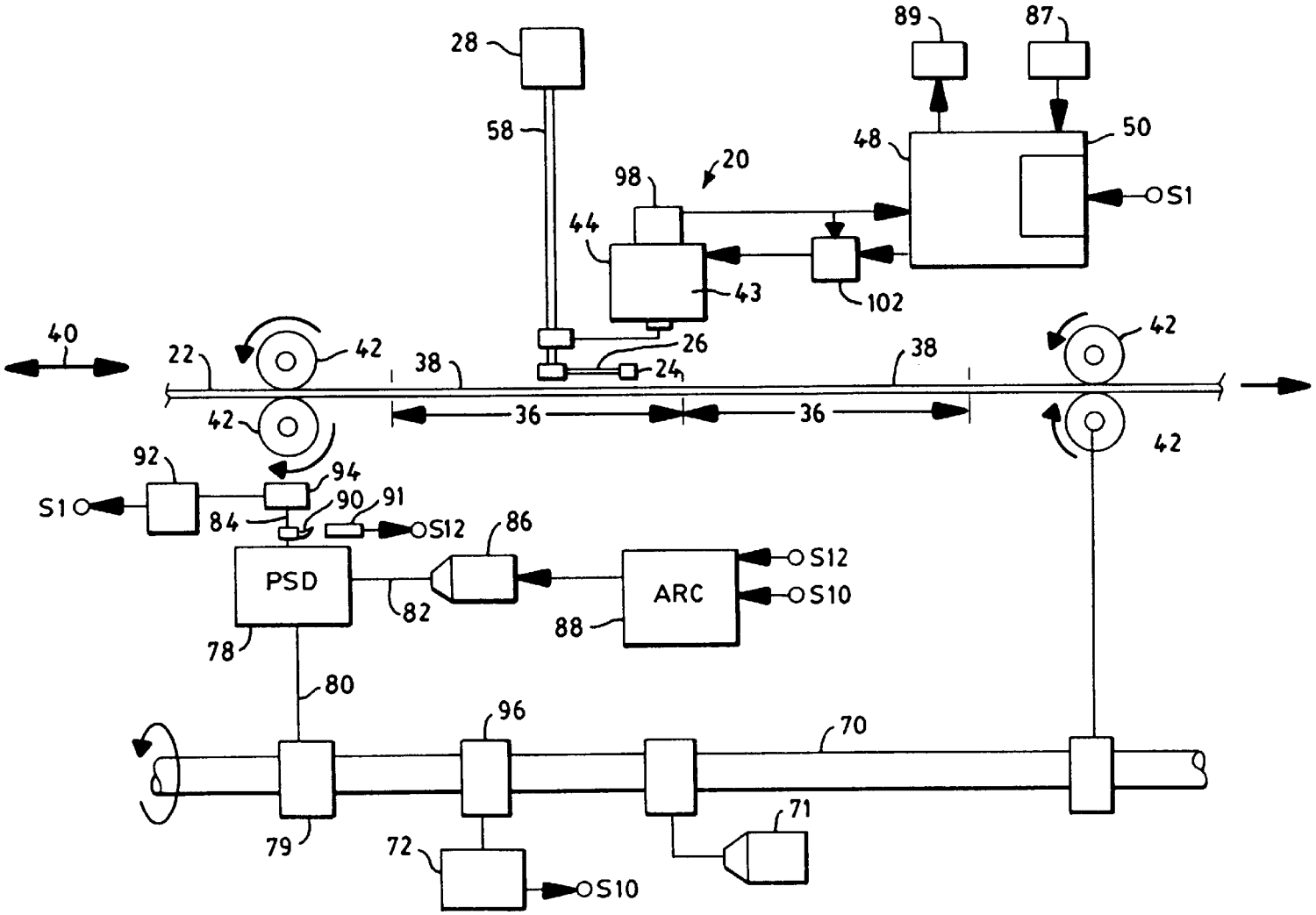
FIG. 1 representatively shows a schematic of a manufacturing line which incorporates the apparatus and method of the present invention.
Figure 2:
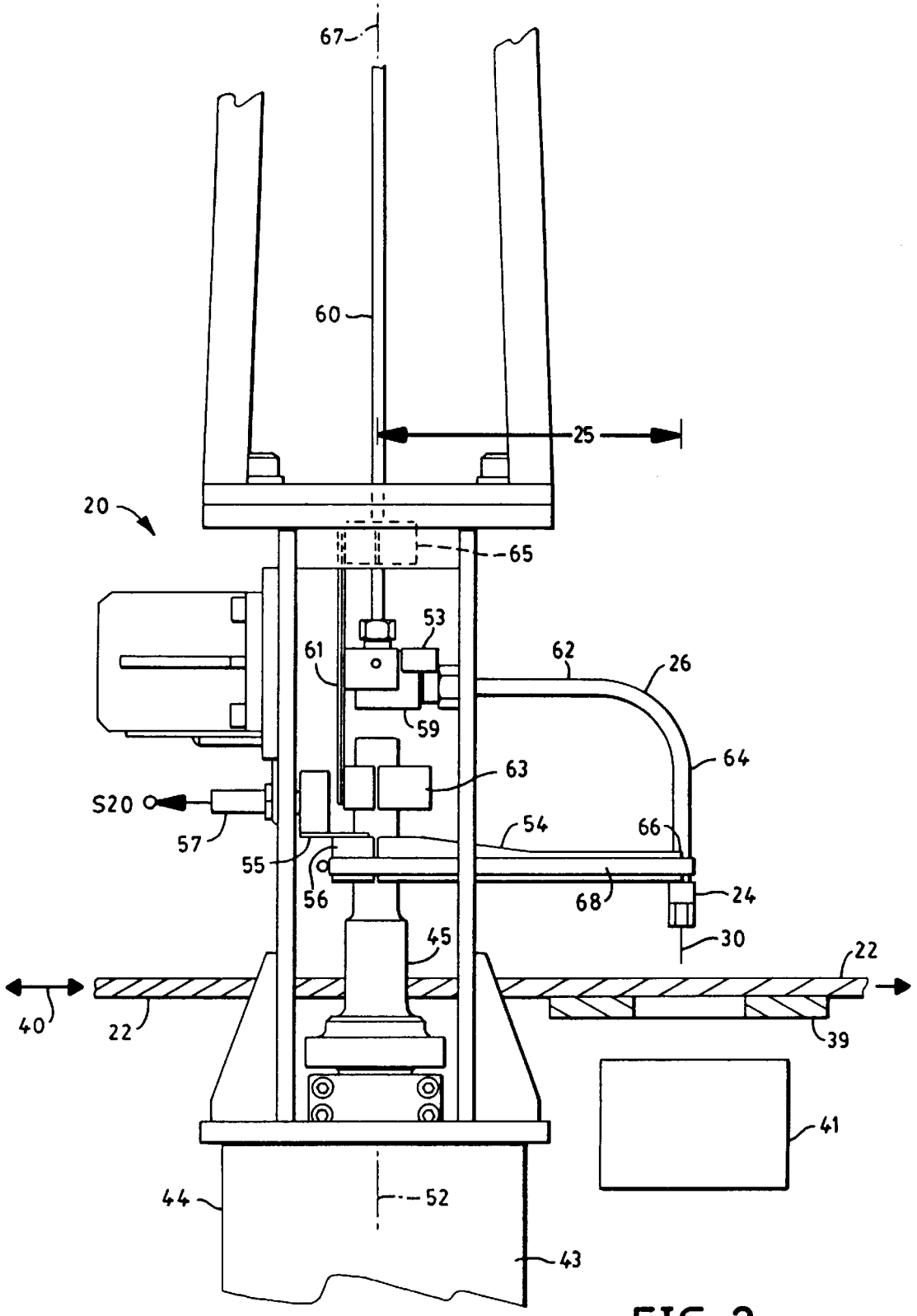
FIG. 2 representatively shows a side view of a cutting system of the invention.

With reference to FIGS. 1 and 2, an apparatus for directing a selected fluid onto a moving substrate in a selected pattern includes a nozzle 24 connected to a movable support 26, and a supplying means, such as a mechanism including a reservoir 28, provides the fluid to the nozzle at a pressure which provides for a selected fluid flow rate from the nozzle. A designating means, such as a mechanism having a line shaft encoder 72, identifies a plurality of selected lengths, such as article lengths 36, along the substrate 22, and a transporting means, such as a conventional conveyor system 42, moves the substrate 22 at a predetermined speed along a machine direction 40 during the directing of fluid onto the substrate. An actuating servo 44 moves the nozzle 24 along a selected delivery path, such as cutting path 46, and a regulating means 48, such as a mechanism including a microprocessor, controls the actuating servo 44 by employing a selected, electronically stored data set 50. The data set is configured to move the actuating servo 44 in a selected sequence, and the sequence has a predetermined correspondence with the movement of the substrate 22 to thereby direct the nozzle 24 along the selected delivery path and provide the selected pattern, such as cut pattern 32 (FIG. 3), onto the substrate.

The fluid directed onto the substrate may be viscous or substantially nonviscous, and the fluid may be deposited onto or into a surface of the substrate, or may be directed onto and through the substrate. For example, the fluid may be a liquid, such as an adhesive, a surfactant, a surface treatment or the like, a stream of which is distributed in a desired pattern onto a facing surface of the substrate. Alternatively, the fluid may be processing stream which provides a manufacturing operation, such as cutting, slitting, perforating, needling or the like. Accordingly, the fluid stream may be diffused to cover a selected distributed area, or concentrated to cover substantially a point or line.

Figure 3:
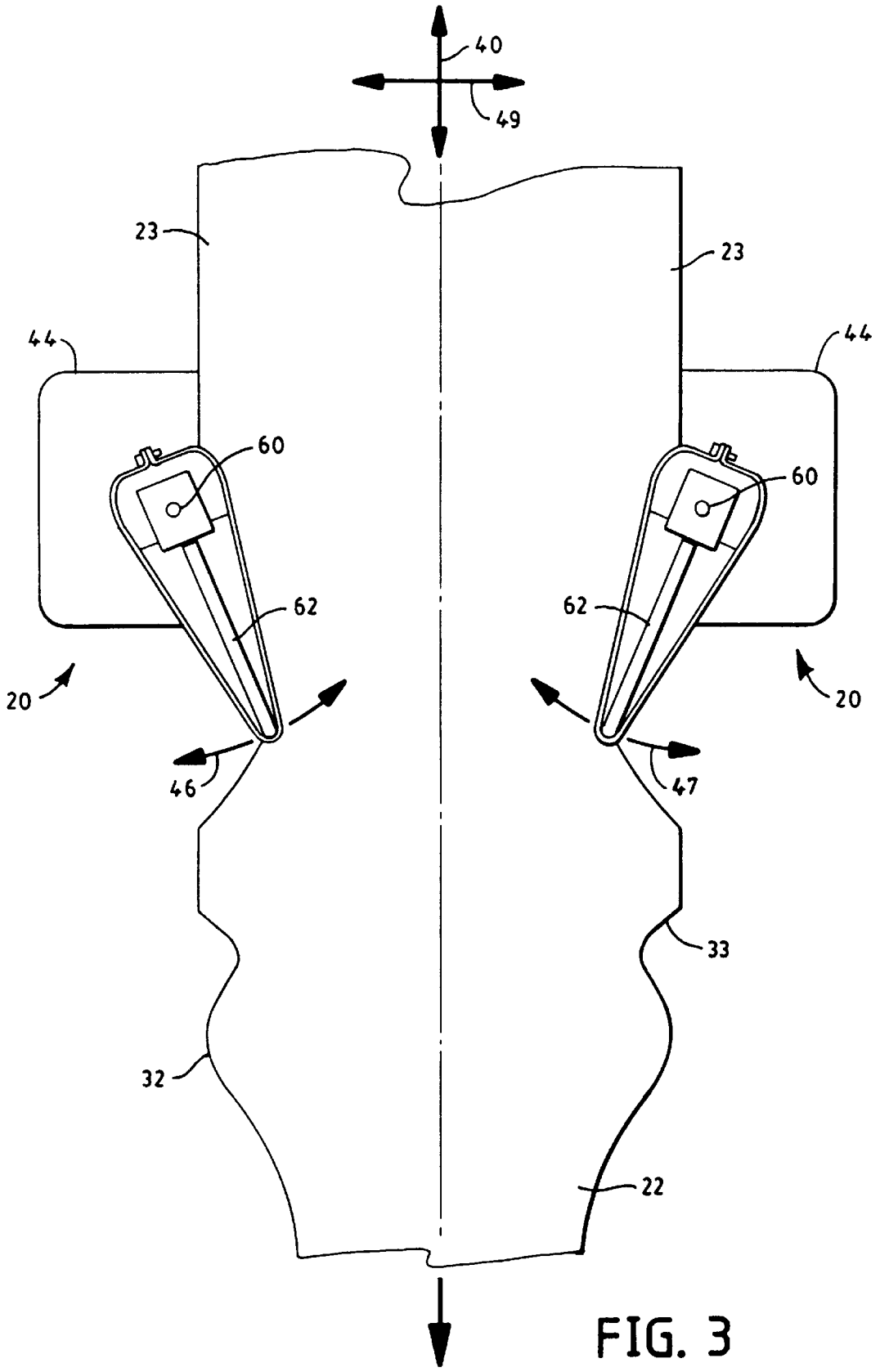
FIG. 3 representatively shows a top view of a cutting system configured to generate a pair of mirror-image cutting patterns.

In particular aspects of the present invention, for example, an apparatus 20 for cutting a moving substrate 22 can include a cutter nozzle 24 connected to a movable support 26. A fluid supplying means, such as a reservoir 28 provides a cutting fluid 30, such as water, to the cutter nozzle 24 at a pressure which provides for a selected fluid flow rate from-the-cutter nozzle, and the fluid flow rate is sufficient to cut the substrate 22 in a selected cut pattern 32 (FIG. 3). A designating means, such as a mechanism which includes line shaft encoder 72, can be configured for identifying a plurality of selected article lengths 36 along the substrate 22. The article lengths can, in turn, define a plurality of article segments 38 which are interconnected along a machine direction 40 of the apparatus. A transporting means, such as a conventional conveyor system 42, moves the substrate 22 at a predetermined speed along the machine direction 40 during the cutting of the substrate 22, and an actuating servo 44 moves the cutter nozzle 24 along a selected cutting path 46 (FIG. 3). A regulating means 48, such as a mechanism including an electronic microprocessor, can be constructed and arranged to control the actuating servo 44 by employing a selected, electronically stored data set 50. The data set is configured to move the actuating servo 44 in a selected routine or sequence. The sequence has a predetermined correspondence with the movement of the substrate 22 to thereby direct the cutter nozzle 24 along the selected cutting path 46 and provide the selected cut pattern 32 on the substrate 22.

A suitable data input device 87, such as an IBM-compatible personal computer (PC), can be employed to allow an operator to provide the method and apparatus of the invention with any required operating parameters. An example of a suitable computer is a Toshiba T3200SX personal computer. In addition, a display monitoring system 89, such as a NEMATRON display unit, can be employed to display operational data and system status. An example of a suitable display monitor is a NEMATRON IWS 1523 cathode ray tube (CRT) device which Is available from NEMATRON, a subsidiary of Interface Systems, Inc., a business having offices in Ann Arbor, Mich.

For the purposes of the present invention, the terms "datum", "data" and "signal" are to be interpreted in a general sense, and are intended to designate various types of characterizing information produced during the operation of the invention. Such types of information can include, but are not limited to, information in the form of impulses or signals which can be mechanical, magnetic, electrical, electromagnetic, or combinations thereof.

At a particular location along the apparatus or method, the machine direction is a generally length-wise direction along which a particular web (or composite web) of material is moving through the system. In addition, a cross-direction extends generally along the plane of the web of material and is perpendicular to the particular machine direction established by the system at the location being observed.

The following detailed description will be made in the context of a substrate 22 which is employed to construct an interconnected plurality of absorbent articles, such as disposable diapers, incontinence garments, sanitary napkins, training pants and the like. It should be readily apparent, however, that the method and apparatus of the invention may also be employed with other types of substrates and other types of articles, such as caps, gowns, drapes, covers and the like.

Substrate 22 may be a single layer or may include a plurality of layers. For example, the substrate 22 may be composed of one or more layers of tissue wrap, such as cellulosic tissue, placed around an absorbent core. As another example, the substrate 22 can be a laminate composed of the backsheet layer and topsheet layer of a selected article. The substrate 22 may further include a continuous or intermittent layer of absorbent material, such as wood pulp fluff, which is sandwiched between the backsheet and topsheet layers to provide an absorbent core. It should be readily apparent that the invention can also be employed to form desired cut patterns on other moving substrates having different configurations.

In the embodiment representatively shown in FIG. 1, substrate 22 comprises a composite web, which in turn defines a representative, interconnected plurality of article segments 38 employed to produce articles, particularly diapers. A plurality of additional components, such as absorbent pads, fastening tapes, and elastic members can be incorporated into the substrate 22 to produce the interconnected plurality of diaper articles. The absorbent pads can be substantially regularly spaced along the machine direction 40 of the substrate 22, and the individual, adjacent pads can be separated from each other by a discrete distance. During the manufacturing process, the interconnected article segments 38 are cut or otherwise separated apart to form the individual articles.

The various layers and components forming the article segments 38 of substrate 22 can be secured together by any of a number of suitable conventional techniques, such as adhesive bonding, thermal bonding, sonic bonding, or the like, as well as combinations thereof. Typically, extruded lines, beads, or looping swirls of hot melt adhesives can be employed to secure together the various components. Suitable adhesives can include hot melt adhesives, pressure-sensitive adhesives or the like. If desired, the adhesives may be applied by conventional spray techniques or swirled filament techniques. During the construction of selected articles, it can be desirable to form one or more cut patterns 32 (FIG. 3) along the machine direction 40 of the substrate 22. For example, the cutting apparatus 20 can be employed to cut away selected edge portions of the substrate which correspond to the leg openings of individual diaper articles.

Figure 4:
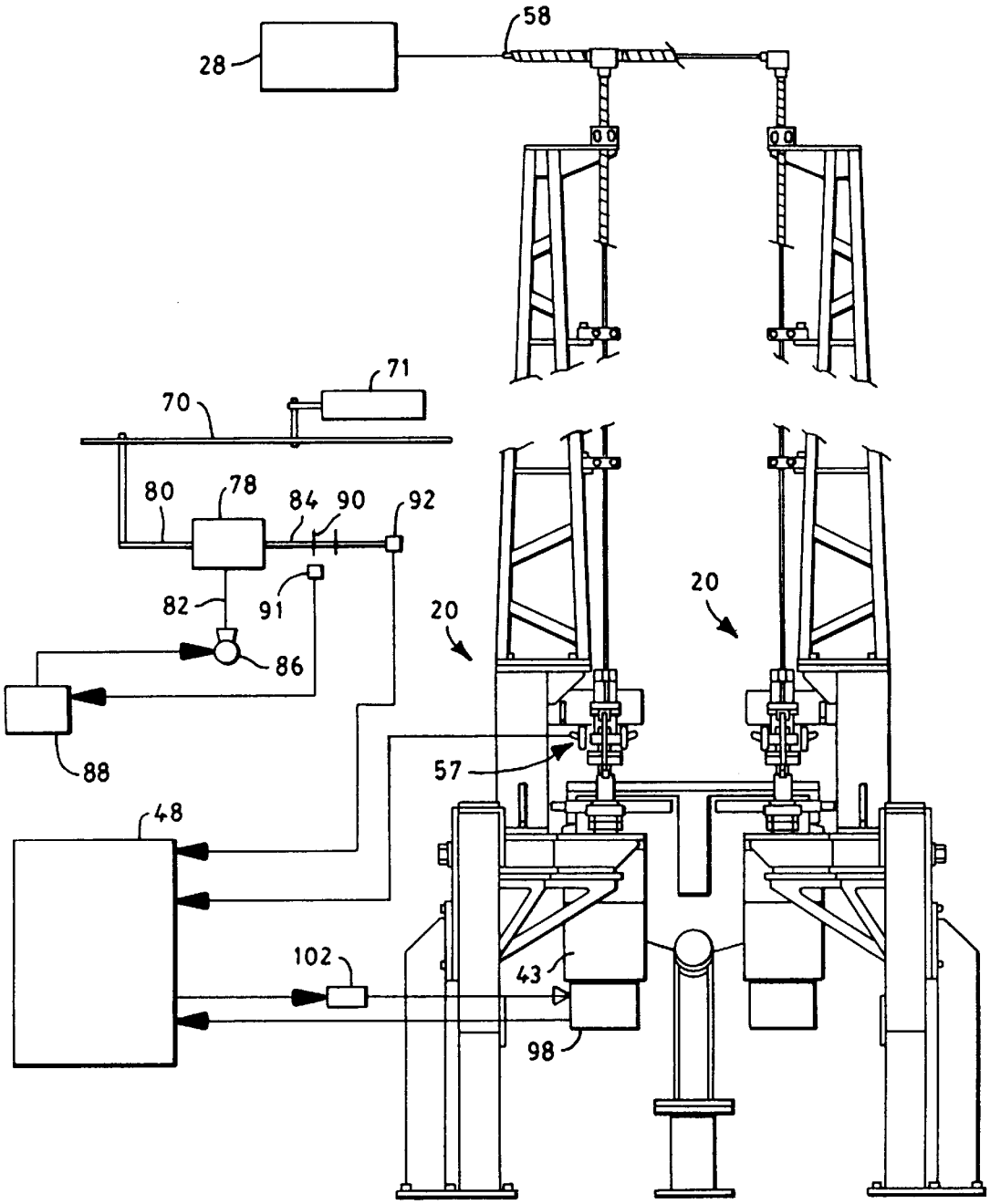
FIG. 4 representatively shows an end view of a cutting system of the invention for producing a plurality of cut patterns, along with a schematic diagram of a regulating and control system.

The present invention can be configured to provide a single cut pattern 32 or a plurality of cut patterns. In the configuration representatively shown-in FIGS. 3 and 4, for example, a complementary pair of the mechanisms of the invention are configured to produce a first cut pattern 32 along one cross-directional side edge of substrate 22 and a second cut pattern 33 along an opposed second side edge region of the substrate. More particularly, the illustrated embodiment is arranged to provide a second cut pattern 33 which is substantially a complementary, mirror image of the first cut pattern 32. Accordingly, the shown arrangement of the invention includes a second actuating system for moving a second cutter nozzle along a second cut path 47. The second cut path traversed by the second cutter nozzle is substantially a mirror image of the first cutting path 46.

The present description will be made in the context of a single servo driven water cutter device, and the description of the interacting components will be made in the context of a single control system controlled to regulate the cutter apparatus and method. It should be readily appreciated, however, that an alternative cutting system could employ a multiplicity of two or more servo actuators 44 which operably drive and control additional individual nozzles 24. Accordingly, each of the additional actuating servos, and associated mechanical and electronic components, would be similar to the configuration of components described with respect to a single servo driven device.

In the various arrangements of the invention, the cutter nozzle 24 can comprise a low mass, orifice mount assembly ("jewel") which is held in position by a low mass, retaining nut. The jewel and nut can be of various sizes. For example, a Jewel and nut having a length of about ⅝ inch can have a weight of about 16 gm; a jewel and nut having a length of about 1 inch can have a weight of about 23 gm; and a jewel and nut having a length of about 3 inch with a ¾ inch diameter can have a weight of about 200 gm. To improve the acceleration capabilities of the cutting system, the weight of the cutter nozzle is desirably as low as possible.

A suitable cutter nozzle 24 is an orifice mount assembly retained by a low mass nozzle nut, available from FLOW International, a company having offices located in Kent, Wash.

Typically, the cutter nozzle 24 is composed of a durable, wear resistant material which is not readily eroded by the selected cutting fluid. For example, the cutter nozzle may include a Jewel composed of sapphire or diamond and having a fluid passageway and orifice formed therethrough for producing the desired cutting stream.

In the representative example of the illustrated embodiment, the supplying means employed by the present invention can include a reservoir system 28 which is constructed to provide a suitable gas or liquid, such as water or the like, at a desired cutting pressure and flow rate.

Conventional systems for providing high pressure water into a water cutting system are well known in the art. For example, a suitable system can be a Model 9X Intensifier Pump system available from FLOW International.

The reservoir system 28 provides the cutting fluid into a suitable delivery system, such as a system having a conduit 58. For example, in the configuration of the invention representatively shown in FIG. 2, the delivery system includes a torque tube section 60, an extending arm section 62, and a nozzle body support section 64. In the shown arrangement, the arm section 62 and support section 64 are arranged to cooperatively provide a nozzle body, which in turn, provides the nozzle support 26 which carries the nozzle 24. As illustrated, the torque tube section 60 and the nozzle support section 64 can extend substantially vertically and can be arranged generally perpendicular to the plane generally defined by the substrate 22. The arm section 62 is aligned generally parallel to the plane of the substrate. It should be appreciated that other alternative, operable geometries and alignments may also be employed without departing from the invention.

It should be readily appreciated that the fluid delivery conduit system 58 is constructed of a material which is capable of withstanding the stresses and strains imposed by the high pressure water traveling therethrough, and by the mechanical operations of the cutting system. For example, the various components of the fluid delivery conduit may be composed of a 316 stainless steel material.

The conduit arm section 62 extends generally radially away from the lengthwise axis 67 of the torque tube section 60, and has a laterally extending length which is sufficient to produce the desired cut pattern 32 on substrate 22. In the illustrated arrangement, for example, the conduit arm section 62 bends through an arc of approximately 90° and further extends to merge into the nozzle support section 64. Accordingly, the conduit arm section 62 and the nozzle support section 64 suitably cooperate to locate nozzle 24 at a desired radial position distance 25, which spaces the nozzle laterally away from the longitudinal centerline axis 67 of the torque tube section. In the illustrated embodiment, for example, the nozzle radial distance 25 can be about 17.8 centimeters. In particular aspects of the invention, nozzle distance 25 can be not more than about 24 inches (about 61 cm) or more. Alternatively, the nozzle distance 25 can be not more than about 14 inches (about 36 cm), and optionally can be not more than about 10 inches (about 25.4 cm) to provide improved performance. A longer nozzle distance 25 can also be employed as long as the resultant inertial load does not exceed the power capabilities of the actuating servo system.

In other aspects of the invention, the nozzle radial distance 25 is at least about 3 inches (about 7.6 cm). Alternatively, the nozzle radial distance is at least about 5 inches (about 12.7 cm), and optionally, at least about 6 inches (about 15.2 cm) to provide improved performance. If the nozzle radial distance is too small, the travel distance of nozzle 24 may be insufficient to generate the desired pattern 32.

The transporting means for the cutting system of the invention can be any suitable device which operably translates the substrate 22 past the location of the cutter nozzle 24 at the desired speed. For example, the transporting mechanism may comprise a system of belts, cushions or jets of fluid, supporting fields of electromagnetic energy, conveying rollers, or the like. The illustrated configuration, for example, employs a system of conveying rollers 42.

The conveying rollers can be operably driven by a lineshaft 70, which in turn can be driven by a suitable power system, such as a drive motor 71. In particular aspects of the invention, the driving force of lineshaft 70 can be coupled to the conveying rollers 42 by a mechanical or electrical drive system, such as a system having a motor and/or belts, pulleys, chains or any other suitable mechanism. A phase shifting device 78 (PSD) is constructed and arranged to operably adjust the movement of a gearing encoder 92. The phase shifting device 78 can advance or retard the movement of the cutter nozzle 24 by advancing or retarding the gearing encoder 92, which in turn, advances or retards the execution and implementation of the data set 50, and thereby provides a desired registration and phasing between each appointed article segment 38 and selected regions or portions of the cut pattern 32. In particular, the phase shifting device can operably match each article segment to a periodically occurring, repeat segment 35 (FIG. 6) of the cut pattern.

A suitable phase shifting device is a SPECON device manufactured by Fairchild Industrial Product Company, a business having offices located in Winston-Salem, N.C. A particular SPECON device suitable for the present invention is a SPECON Model 4PSD-100.

In the shown embodiment, the phase shifting device 78 includes a first input shaft 80, a correction input shaft 82 and an output shaft 84. The first input shaft 80 is operably connected to lineshaft 70 by a suitable coupling mechanism 79. The various coupling mechanisms employed with the present invention may comprise a gearing mechanism, a gear and chain mechanism, a belt and pulley mechanism, an electronic gearing system, a hydraulic coupling mechanism, a fluid-mechanical coupling system, an electromechanical gearing system, or the like.

The output shaft 84 (OS) is related to the input shaft 80 (IS) and the correction shaft 82 (CS) such that the revolutions of the output shaft 84 equal the revolutions of the input shaft 80, plus or minus, the revolutions of the correction shaft times a scale factor. This relationship can be expressed by the formula:

$$OS\ \text{revs}=(IS\ \text{revs})\pm(CS^{*}\ \text{scale})$$

Therefore, turning the correction shaft in one direction or the other causes the rotation of the output shaft to advance-or retard relative to the turning of the input shaft 80.

The correction shaft 82 can be operably driven by a correction motor 86, and in a SPECON device, the correction motor is provided by Reliance Electric Company, a business having offices located in Cleveland, Ohio. The correction motor 86 turns the correction shaft 82 in the appropriate direction, as controlled by a computer 88 within an automatic registration control (ARC) system. The computer can, for example, comprise a VME-based microprocessor. In a suitable configuration, the VME unit comprises a PME 6823 CPU which is available from Radstone Technology Corp., a business having offices in Montvale, N.J.

The transporting means is constructed to move the substrate 22 at a speed of at least about 100 ft/min (about 0.51 m/sec). Alternatively, the substrate can be moved at a substrate speed of at least about 300 ft/min (about 1.52 m/sec), and optionally at a substrate speed of at least about 800 ft/min (about 4.1 m/sec). In particular aspects of the invention, the transporting means is configured to move the substrate at a speed of not more than about 2000 ft/min (about 10.2 m/sec). Optionally, the substrate speed can be not more than about 1750 ft/min (about 8.9 m/sec), and optionally, can be not more than about 1500 ft/min (about 7.6 m/sec). Higher or lower substrate speeds may also be provided, as desired, by employing conventional conveying systems that are known in the art.

Figure 5:
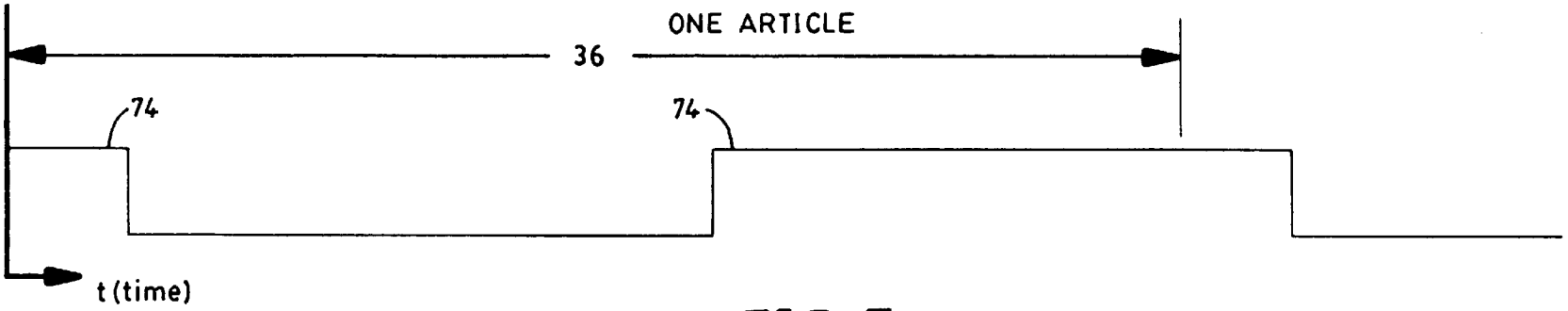
FIG. 5 shows a schematic of a representative marker pulse produced by an encoder.

The designating means for identifying the plurality of selected article lengths 36 and interconnected article segments 38 along the machine direction 40 can, for example, comprise a lineshaft encoder 72. The shaft encoder 72 provides reference, position data regarding the location of each article length along the substrate and along the machine direction 40 of the apparatus. The position data can include marker pulses 74 which operably correspond to the position and presence of an individual article segment 38 of substrate 22. In the shown arrangement of the invention, the marker data has the form of electrical impulse signals, as representatively shown in FIG. 5. In other arrangements, the shape of the marker pulse may be different, and/or the duration of the marker pulse may be longer or shorter, depending upon the make of the particular encoder device. The electrical signals are routed through suitable electrical conductors S10 to a processing unit, such as computer 88. In the representatively shown configuration, the marker pulse 74 occurs one time per article length 36, and is desirably configured to indicate a machine period or distance which corresponds to a single article segment 38. The marker pulse is typically employed to obtain the phase relationships between the various electrical signals and of the various component elements of the apparatus and method.

Figure 5A:
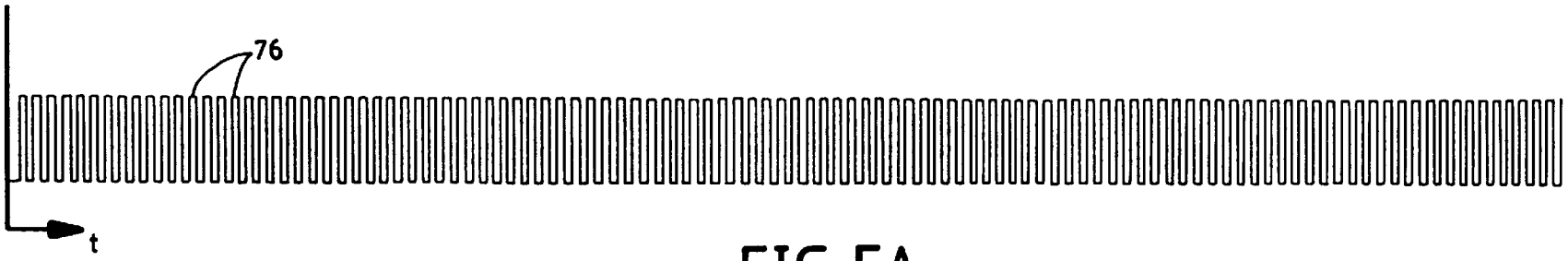
FIG. 5A representatively shows a schematic of a series of phasing pulses produced by an encoder.

The lineshaft encoder 72 can further include a metering system for generating substantially regularly occurring phasing pulses 76 as representatively shown in FIG. 5A. The lineshaft encoder in the shown configuration of the invention generates approximately 2000 phasing pulses per encoder revolution. The lineshaft 70 can be configured to rotate a predetermined number of times per article length 36. For example, the lineshaft 70 can be configured to turn once per article length 36. Accordingly, the lineshaft encoder can produce 2000 phasing pulses for each article length 36 and each article segment 38. Alternatively, the lineshaft 70 can be configured to turn twice per article length 36, and the lineshaft encoder can be geared to the lineshaft to turn once for every two revolutions of the lineshaft. The lineshaft encoder would again produce 2000 phasing pulses for each article length 36 and each article segment 38.

In the various configurations, a predetermined number of phasing pulses occur per increment of distance traveled along the machine-direction by each point on the substrate 22. As a result, the phasing pulses can be employed as a "ruler" to measure the phase and position relationships between the various electrical signals generated by the invention, can be employed to develop desired measurements of the distances traveled by substrate 22 through the apparatus. In the shown configuration, the phasing pulses 76 are provided in the form of electrical signals, which are suitably directed to computer 88 through appropriate electrical conductors S10. An example of a suitable lineshaft encoder unit suitable for use with the present invention is a model 63-P-MEF-2000-TO-00GH90863 unit available from Dynapar Company, a business having offices in Gurney, Ill.

The shown configuration includes a cutter reference flag 90 which is connected to turn with the output shaft 84 of the phase shifting device 78. Output shaft 84 can be configured to turn once for each article length 36 and article segment 38. Accordingly, when flag sensor 91 detects each passage of the reference flag 90, a signal can be sent to computer 88 through conductor S12. The flag sensor provides to computer 88 position information which can be used by the computer to generate appropriate phasing. In particular, the computer 88 can compare the timing (number of phasing pulses) between the signal from flag 90 and the marker pulse information provided from the lineshaft encoder 72. The computer is programmed with a predetermined, desired timing relationship. If the timing relation changes, computer 88 directs the correction motor 86 to turn in a direction which advances or retards the turning of the output shaft 84, and thereby reestablish the desired timing and phasing relationship.

The output shaft 84 is connected through a suitable coupler 94 to turn a gearing encoder 92, and in the illustrated arrangement, the gearing encoder can be configured to turn once per revolution of the output shaft 84. As a result, the phase shifting device 78 adjusts the rate of turning of the gearing encoder 92 and thereby adjusts the rate of stepping through the data set 50 stored in the regulating means 48. As a result, the signal from the gearing encoder 92 can be used to operably phase the operation of the cutting apparatus 20 relative to the actual movement of each article segment 38.

A suitable gearing encoder 92 can be a model No. H25D-SS-2500-ABZC-8830-LEDSM1 gearing encoder available from BEI Motion, a business having offices located in Golita, Calif. As previously described, the gearing encoder can be configured to provide a marker pulse of selected duration to identify each article length 36 and article segment 38, and a series of phasing pulses to measure the position of each article 38 relative to the cutting apparatus 20. In the illustrated arrangement of the invention, for example, the gearing encoder 92 can be constructed to provide two channels of phasing pulses, for each article length of each article segment 38. Each channel has 2500 phasing pulses while phasing pulses in one channel are offset from the pulses in the channel by a phase angle of about 90°.

In the arrangement representatively shown in FIG. 2, the servo motor and nozzle 24 are appointed for positioning at locations which are relatively adjacent to opposite surfaces of the substrate 22. The actuating servo 44 can include a servo drive mechanism, such as servo motor 43, a servo output shaft 45 and a servo arm 54. The servo motor is constructed and arranged to provide the torque and accelerations required to move the cutter nozzle 24 along its cutting path 46 in the routine of sequential movements needed to generate the desired cut pattern 32. Accordingly, the peak torque requirements and the power requirements based upon RMS (root mean square) current and voltage will depend on the desired movement speed of substrate 22 along the machine-direction, the desired contour of the cutting pattern 32 and the inertia of the combination of components employed to carry the cutter nozzle 24 and move the nozzle along its selected cutting path 46. In the shown embodiment, for example, the servo motor 43 is configured to provide a maximum RMS torque of about 250 inch-pounds at a RMS current of about 31 amperes, and can provide a peak torque of about 758 inch-pounds at a RMS current of 96 amps. As a result, the servo motor can generate the repeat segments of the cut pattern 32 at a cycle rate of up to about 1000 cycles per minute or more. An example of a suitable servo motor is a Reliance S-6300-S-J00AB motor, which is available from Reliance Electric Company.

The various configurations of the invention can employ a power amplifier 102 (FIG. 4) to drive the servo motor 43. The shown arrangement, for example, includes an amplifier 102 which supplies current, such as a 3-phase current, to the motor 43 in response to a reference signal received from the regulating means 48. The reference signal in the shown configuration is an analog signal, but may be a digital signal. The amplifier can be operated in a torque mode, in which the amplifier interprets the signal as a command for a desired torque. The current output of the amplifier is desirably limited so as not to exceed the current rating of the motor 43. A suitable amplifier is a HR 2000 amplifier which is available from Reliance Electric Company.

The representatively shown servo motor 43 includes an output shaft 45. In the various configurations of the invention, the output shaft may comprise a shaft extension to provide desired clearance around the motor and allow a desired attachment of other mechanical components, such as mechanical stops, the servo arm 54, a nozzle body band clamp 68, and any desired proximity switch flag references. The shaft extension can, for example, be made from a high-strength steel, such as 17-4PH H1075, which can withstand the applied cyclic loads without fatigue failure.

The extension can be secured to the servo motor shaft by any suitable mechanism, such as a split clamp which squeezes tightly around the servo motor shaft to prevent slippage.

The output shaft 45 can optionally include a pair of stop lobes to mechanically control and limit the arc of rotation of the motor output shaft. The stop lobes can be configured to contact selected, fixed mechanical stops in the event that the motor shaft should swing out of its desired arc length, range of rotation.

The servo arm 54 is attached and secured to the motor output shaft 45 with any suitable attaching mechanisms, such as a clamping device. The servo arm 54 operably transmits the torque and rotation of the servo motor 43 to the cutter nozzle 24 to move the nozzle back and forth in the desired travel routine along the arc length of the nozzle cutting path 46 (FIG. 3).

It is known that a motor-to-load inertia ratio of 1:1 is desired for high performance applications which require high torque and high accelerations. It has, however, been difficult to provide a servo arm 54 and nozzle-body having the relatively low, rotational mass moment of inertia needed to generate the desired 1:1 inertia ratio. In particular aspects of the invention, the rotational inertia of the overall load driven by the servo motor can be constructed to be not more than about 1.6 lbs-inch-seconds$^2$. Alternatively, the rotational inertia of the overall load can be not more than about 0.4 lbs-inch-seconds$^2$, and optionally can be not more than about 0.1 lbs-inch-seconds$^2$. In other aspects of the invention, the rotational inertia of the overall load can be as low as about 0.02 lbs-inch-seconds$^2$. Alternatively, the rotational inertia of the overall load can be as low as 0.01 lbs-inch-seconds$^2$, and optionally can be as low as 0.005 lbs-inch-seconds$^2$ to help provide the desire rates of acceleration.

The configuration and low load-inertia of the servo system of the present invention can advantageously provide for a rotational acceleration which can be as low as zero radians/seconds$^2$. In addition, the present invention can be configured to provide a rotational acceleration of at least about 200 radians/seconds$^2$. Alternatively, the provided rotational acceleration can be at least about 1,000 radians/seconds$^2$, and optionally, can be at least about 5,000 radians/seconds$^2$ to allow the cutting of more rapidly changing cut patterns in a rapidly moving substrate. In further aspects, the invention can be configured to provide a rotational acceleration of up to about 11,000 radians/seconds$^2$, and optionally, can provide a rotational acceleration of up to about 96,000 radians/seconds$^2$ to allow the cutting of desired patterns.

The cutting system of the present invention can also be advantageously configured to locate the cutting servo 44 at a location which is generally adjacent to the outboard lateral side edges 23 of the substrate 22. The arrangement can be provided by employing the conduit arm section 62 and the low-mass servo arm 54.

A suitable servo arm 54 can include an expanded polystyrene foam core covered with a graphite fiber sheet composite. An example of a servo arm of this type is a Model No. 733 servo arm available from Courtaulds Aerospace, a company having offices located in Bennington, Vt.

An extended distal end of the servo arm 54 includes a servo arm seat section 66, which is configured to hold and carry the conduit support section 64 of the nozzle body. A second end portion of the servo arm, which is opposite the servo arm seat section 66, can include a proximity switch flag 55, such as a flag composed of a ferrous or nonferrous material. A servo arm flag sensor 57, such as a magnetic induction sensor, is suitably constructed and arranged to detect the presence of the servo arm flag 55 and to generate an appropriate output signal through electrical conductor S20. Other operating components, such as a dual-axis card within the regulating means 48, can then use the signal data from S20 as a known point of reference. For example, the servo arm flag 55 and servo arm sensor 57 can be employed to detect and establish a predetermined "home" position for the servo arm. The home position can provide an initial set reference point relative to which the subsequent movements of the servo arm can be measured. The home proximity sensor 57 can also provide a position reference used to correct the motor position in case electrical noise interferes with the integrity of the position signal data from the gearing encoder 92 and the motor encoder 98. Additional proximity limit switch sensors can also be employed to monitor the arc of rotation of the servo arm 54. If the servo arm flag 55 passes by one of the proximity limit switches, the current supply to the servo motor 43 can be shut off to stop the rotation of the servo motor.

A torque tube attaching bracket 61 connects to the motor output shaft 45 with a lower securing mechanism, such as lower clamp 63, and connects to the conduit torque tube section 60 with an upper securing mechanism, such as upper clamp 65. The shown embodiment also includes an intermediate clamp 53 which attaches to the high pressure Junction 59. The attaching bracket 61 helps to direct the rotational twisting motion from the servo output shaft 45 into the torque tube section 60. The intermediate clamp 53 operably holds in position the high pressure elbow junction 59, which in turn connects to the conduit arm section 62 of the nozzle body. In the representatively shown configuration, the conduit arm 62 forms a curved elbow and is composed of a material capable of withstanding the pressure of the water cutting fluid. The conduit arm 62 can, for example, be composed of a tube composed of 316 stainless steel having a suitable size, such as an outside diameter of about ¼–⅜ inch. The conduit arm section 62 and the conduit nozzle support section 64 can provide a high pressure water reservoir for the cutter nozzle 24. The terminal and of the nozzle support section 64 can be threaded for the attachment of cutter nozzle 24. The end of conduit support section 64 is held in place at the terminal end of servo arm 54 in the servo arm seat section 66 which can, for example, include a suitably sized and shaped notch. The band clamp 68 encircles the servo arm 54 and the end of conduit support section 64 to substantially prevent any movement therebetween.

As substrate 22 moves past the position of cutter nozzle 24, the apparatus and method of the invention can further employ a dead plate 39 to support the moving substrate 22. In addition, the cutting system can include a collection mechanism, such as water receiver 41, for receiving the spent cutting fluid.

The various configurations of the invention can additionally include an energy storage system for absorbing the energy and twisting motion produced by the actuating servo 44. By absorbing the energy, the present invention can avoid the use of Joints and associated seals that can degrade and cause leakage of the cutting fluid. The absorbed energy can also be reconverted back to kinetic energy to facilitate desired motions within the mechanical system. In the illustrated arrangement, for example, the representative energy storage system includes the torque tube conduit 60. The torque tube conduit is constructed of a material which is capable of elastic deformations in torsion, and is configured so that the cyclical torsional stress and strain are below the fatigue limit of the torque tube material. For example, the torque tube 60 can be composed of 316 stainless steel, and in particular aspects, the torque tube 60 can have a longitudinal length which is as low as about 24 inch (about 61 cm). In other aspects, the torque tube length can be at least about 48 inch (about 121 cm). Alternatively, the length of torque tube 60 can be at least about 36 inch (about 152 cm), and optionally, can be at least about 72 inch (about 183 cm) to provide improved performance. It should be readily appreciated that the torque tube length has no upper limit and is restricted only by the limitations of the space in which the cutting system is to be located.

A further aspect of the invention includes a configuration where the longitudinal axis of torque tube 60 is located and maintained in a substantially-collinear alignment with the axis of rotation 52 of the servo output shaft 45 extending from motor 43. This configuration can substantially avoid generating lateral displacements of the torque tube 60, and can substantially avoid placing unnecessary stresses and strains onto the torque tube 60 and the energy storage system.

It should be readily appreciated that other energy storage mechanisms may be employed with the present invention. For example, a mechanical energy storage system may include a length of conduit tubing formed into a spirally and/or helically coiled configuration. The coiled configuration defines a torque axis about which the coil can be twisted to absorb and store mechanical, kinetic energy. For example, in a spiral coil, the torque axis can be substantially defined by a line passing through the geometric center of the spiral, and in a helix coil, the torque axis can be substantially defined by a center line about which the geometry of the helix is formed. Accordingly, in such configurations of the invention, the axis of rotation 52 of the servo output shaft 45 extending from motor 43 can be aligned or otherwise positioned substantially collinear with the torque axis of the selected coil. For example, the conduit tubing can be helically coiled about the motor axis of rotation.

The various configurations of the invention can advantageously impart a desired movement to cutting nozzle 24 without the use of an intermediate transmission system, such as is typically provided by gears, belts, pulleys, cams, or the like. Such transmissions systems can impose additional inertial loads onto the servo actuator, and can impose undesired side loading onto the servo motor. The transmission systems can also introduce undesired amounts of backlash and operational instability. By avoiding such transmission systems, the various aspects of the invention can keep the inertial loads imposed upon the servo actuator 44 at very low levels, can avoid servo side loading, can avoid the introduction of excessive backlash, and can improve operational stability. As a result, the present invention can impart relatively high accelerations, such as high angular accelerations, to the movements of cutter nozzle 24, and can control the nozzle movements with greater accuracy. Optionally, however, an intermediate transmission may be employed with the present invention where the desired movements of the nozzle 24 do not lead to high Inertial loads or to high accelerations, provided the system back lash and the servo side loading are sufficiently reduced or otherwise controlled to provide adequate operational stability.

In addition, the distinctive arrangements of the present invention can readily allow discrete adjustments of the location of the cut pattern 32 relative to the cross-direction 49 of the substrate. In particular, the actuating servo 44, along with its associated components, can be moved laterally along the cross-direction to reposition the resultant cutting pattern, as desired. The system ability to tolerate and readily accommodate lateral repositionings of the actuating servo can further facilitate the production of selected cutting pattern contours, such as contours requiring relatively large traverses of the cutter nozzle along the cross-direction.

In the various arrangements of the present invention, the regulating means 48 is configured to control the actuating servo 44 in a predetermined sequence and routine to direct the cutter nozzle 24 along the cutting path 46 in a routine of sequential movements needed to provide the selected cut pattern 32 on the substrate 22. With the representatively shown arrangement, the routine of sequential movements is composed of a predetermined sequence of rotational movements of the servo arm 54 when driven by the actuating servo motor 43. The regulating means can include a feedback from the actuating servo 44 to generate a predetermined correspondence between the movement of the cutter nozzle 24 and the movement of the substrate 22. In the illustrated arrangement, for example, the feedback is provided for by the servo motor encoder 98 which provides actuator data regarding a location of the nozzle and is operably coupled to the actuating servo motor 43 in a conventional manner.

The motor encoder 98 in this system can serve two functions. It can provide information on motor position to the amplifier 102 so that commutation is performed correctly, and can also provide data representing motor position to the regulating means 48. The servo encoder 98 provides a predetermined number of encoder pulses per revolution of the servo motor 43. Accordingly, the number of encoder counts from the servo encoder 98 can provide information regarding the angular positioning of the servo output shaft 45, and can thereby provide information regarding the positioning of servo arm 54 and the location of cutter nozzle 24.

The illustrated configuration of the invention can, for example, employ a model No. 0018-7014 servo encoder which is available from Reliance Electric Company. The encoder generates two channels of 2500 pulses per revolution of the servo motor 43, with a 90° phase shift between the pulses in the two channels.

The regulating means operably incorporates the selected data set which is electronically stored in a suitable memory mechanism. The data set operably provides a set of path position data which is tabulated in correspondence, with the measured distance along the machine direction of each selected article length along the substrate. The regulating means 48 monitors the position of the substrate 22 and the position of the servo motor 43. The position of the substrate can, for example, be derived from the gearing encoder 92 of the phase shifting device, and motor position can be derived from the motor encoder 98. Accordingly, the actuator motor encoder can provide actuator data regarding the location of the nozzle 24. The position of the gearing encoder determines the point the data set 50 to which the motor position will be compared so that an output, error signal can be generated. A suitable comparator mechanism compares the actuator data to the path position data in the data set 50. The regulating means then processes the error signal to generate an output, reference signal to the amplifier 102. In response to the reference signal, the amplifier 102 alters the current to the motor 43 causing it to rotate in such a manner that the error signal is driven to zero. The actuating servo is thus directed to move to locate the nozzle in substantial accordance with the path position data.

A suitable regulating means can include a "dual-axis" card, such as an AUTOMAX dual-axis card Model No.

M/N57C4228, which is available from Reliance Electric Company. The dual-axis controller card is generally described as a configurable motion control card, which can control two separate axes of motion, with individual quadrature encoder inputs for reference and feedback on each section. The feedback can be velocity or position, and can be incremental (relative) or absolute. The reference can be from the encoder (in gearing or tracking mode), can be from the dual-axis card (index mode), or from the encoder through the dual-axis card (position cam profile). In the shown arrangement, the dual-axis card can be operated in a "once only, position cam, (4X) quadrature" mode. The card can be installed in a Reliance AutoMax Multibus 1 card rack, and can be configured for desired operation with appropriate software. Suitable software may be obtained from Reliance Electric Co.

After the dual-axis card is configured, commands can be given to the dual-axis card by means of the software, and the dual-axis card can in turn provide status information to the software. Actual linear/analog control can be performed by the dual-axis card independent of the software, based upon how the dual-axis card is configured.

The regulating means 48, such as the means provided by the dual-axis card, can perform a number of important functions. In particular, the regulating means can store the data set 50, which in the shown arrangement can represent a desired "cam profile". The cam profile is a sequence of numbers, each number representing a desired motor angle. More Particularly, the motor angle is expressed in terms of a corresponding number of encoder counts provided by the motor encoder 98.

The dual-axis card can also receive signal data from the gearing encoder 92 and the motor encoder 98. The gearing encoder signals provide positional data regarding the article lengths 36 so that the control system can determine which data point on the cam profile should be selected for controlling the servo motor 43. For example, if the gearing encoder has rotated 2500 counts out of a total 10000 per revolution, the correct cam profile data point would be the 20th point on an 80 point cam profile data set. The dual-axis card can interpolate between cam points as needed. The motor encoder 98 provides feedback data on the rotational position of the servo motor 43, and the position data is expressed in encoder counts.

The dual-axis card can generate an error signal based on the difference between the actual motor position indicated by the motor encoder 98, and the desired motor position selected from the cam profile by the dual-axis card. The control system in the dual-axis card "subtracts" the motor-feedback position data from the desired motor position data to generate a raw error signal. The raw error signal is processed to generate a reference signal to the motor amplifier 102.

The raw error signal is processed by the adjustment of four gains within the control system of the dual-axis card. As representatively shown, the gains can be referred to as "proportional gain", "integral gain", "velocity gain" and "feedforward gain".

The magnitude of the gains is determined by the desired cam profile and the motor torque required to generate a movement of the servo motor in correspondence with each cam point of the cam profile. A proper selection of the gains allows the system to operate in a controlled and stable manner. With the dual-axis card, the gains can be adjusted as required to maintain a stable system.

Figure 7:
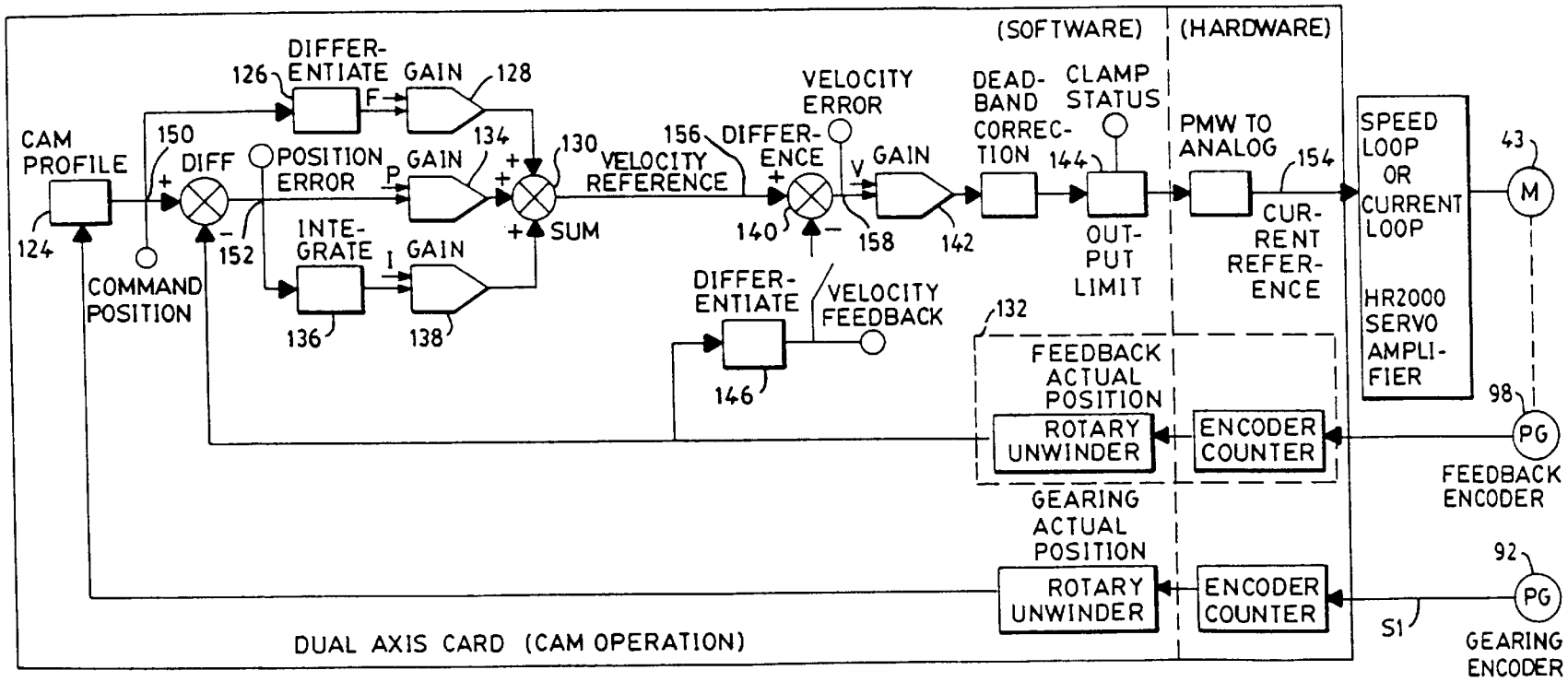
FIG. 7 representatively shows a schematic diagram of the operation of a dual-axis card that can be included in the regulating system employed with the present invention.

A schematic block diagram of the operation of the dual-axis card is representatively shown in FIG. 7. The dual-axis card creates a reference signal based on the stored data set represented by the cam profile 124, and the position data S1 from the gearing encoder 92. As the gearing encoder rotates, the dual-axis card steps through the cam profile points to provide the appropriate command signal. This command signal is indicated as the "command position" signal 150 on the block diagram.

The command signal is processed in two ways. First, the command signal is differentiated at block 126, and is then multiplied by the feedforward gain at block 128. The differentiating produces information regarding the "rate of change" of the command position. The feedforward gain determines how much the "rate of change" is allowed to influence the final reference output to the power amplifier 102. The resultant feedforward output signal is fed to the summer at block 130.

Second, the command position is compared to the motor encoder position data provided from block 132, and a signal called the"position error" signal 152 is generated. The position error is also processed in two ways:

1) The position error is multiplied by the proportional gain at block 134, and the resultant output signal is fed into the summer at block 130. The proportional gain determines how much the position error is allowed to influence the current-reference/torque-command signal 154 which is sent out to the motor amplifier 102.
2) The position error is also integrated over time at block 136, and then multiplied by the integral gain at block 138. The resultant signal Is then fed to the summer at block 130, along with the feedforward gain and proportional gain output signals. The integral gain determines how much the integral error is allowed to influence the current-reference/torque-command output signal 154 to the motor amplifier 102.

The output from the summer, at block 130, is designated as the "velocity reference" signal 156 and is fed to a difference block at block 140. The other input to the difference block 140 is the velocity of the motor feedback signal. The velocity signal is obtained at block 146 by differentiating the feedback encoder position data provided from block 132.

The output of block 140 is designated the "velocity error" signal 158, and is multiplied by the velocity gain at block 142. The velocity gain determines how much the velocity error is allowed to influence the final reference output to the motor amplifier 102.

After block 142, the signal passes on to three more conditioning blocks before emerging as an analog voltage reference signal to the motor amplifier. Of the three blocks, the output limit block 144 is used to scale the reference output to a selected voltage, such as ±8 volts DC, which is the voltage range within which the motor amplifier is designed to work.

The invention can further perform "phasing" which effectively moves the cut pattern 32 relative to the machine-direction in a manner that allows a desired registration between each pattern repeat segment 35 and its corresponding article segment 38. The phasing can be accomplished in two ways. First, by monitoring the signal from the proximity, flag sensor 91, the control computer 88 can provide a signal which causes the phase shifting device 78 to advance or retard. This advances or retards the relative timing of the phasing pulses from the gearing encoder 92, thereby resulting in a proportional machine-directional shift in the selected cut pattern relative to the selected article lengths represented by the article segments 38 along the substrate 22.

Alternatively, the dual-axis card campoint registers can be rewritten during the system operation to electronically shift the cam points stored in the cam table to thereby advance or retard the command position reference associated with a particular cam point in the cam table. This operation also results in a proportional shift in the cut pattern relative to the corresponding article segments or product. In this configuration of the invention, the use of the phase shifting device 78 can be eliminated.

Various cut patterns can be produced in accordance with the present invention, as desired. As representatively shown in FIG. 6, for example, the cut pattern 32 can be a substantially regularly repeating pattern which repeats a selected number of times for each article length 36. In the shown arrangement, the repeating cut pattern has a repeat cycle of one cycle for each article length.

The data set 50 corresponding to the desired cut pattern 32 is generated and stored within the regulating means 48, particularly within the dual-axis card. The data set 50 may be referred to as a cam table composed of cam points. The cam points represent particular angles of rotation of the actuating servo 44, in particular, angles of rotation of the servo motor 43, as indicated by the servo encoder 98 and measured in encoder counts. The particular, individual angle (such as expressed in radians) will depend upon the particular physical arrangement of the cutter apparatus 20. In particular, the angles will depend upon the radial position distance 25 of cutter nozzle 24, and the desired cut pattern 32. Where the cut pattern 32 is a repeating pattern, each repeat cycle of the cut pattern can be generated, by running through the cam table. Subsequent repeat patterns can be generated by repeating the sequence through the cam table.

Figure 6:
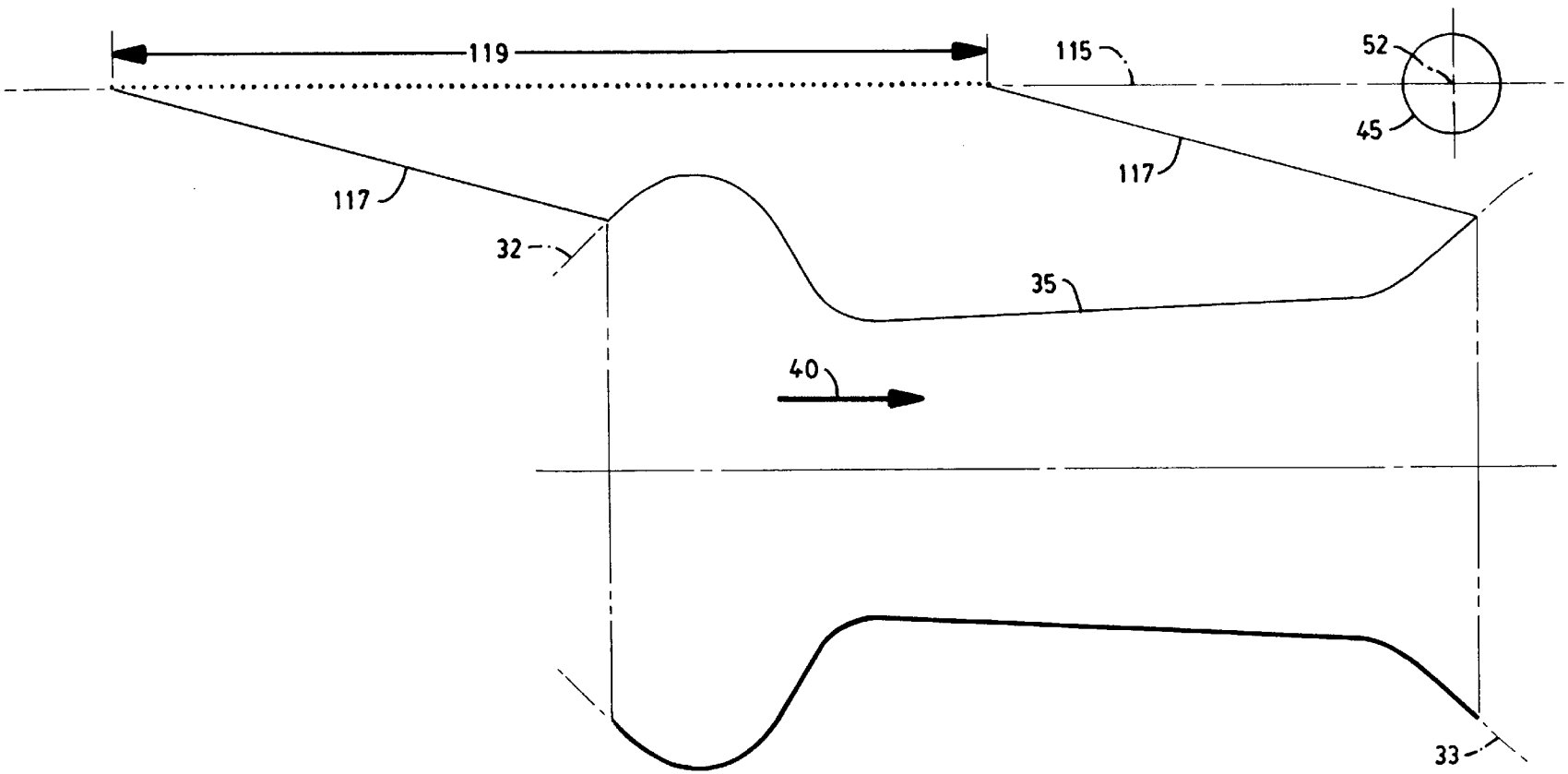
FIG. 6 representatively shows a repeat segment of a cut pattern, along with a schematic of a procedure for generating a data set.

Various techniques can be employed to generate the cam table which represents data set 50. With reference to FIG. 6, for example, an accurate scale drawing of the repeat cycle of the cut pattern 32 can be made and can incorporate a reference centerline of the substrate 22 and a parallel axis line 115 which represents the traveling position of the axis of rotation 52 of the servo arm 54 and the servo motor 43 relative to the selected substrate reference line. The radius line 117 is employed to represent the distance between the servo arm axis 52 and the stream of cutting fluid 30 from the cutter nozzle 24. When the radius line 117 is placed at the opposed ends of the repeat cycle of cutting pattern 32 and is extended in a selected direction along the machine direction 40, which can be oriented upstream or downstream relative to the direction of travel of the substrate 22, the radius line 117 at a first end of the repeat cycle will intersect the axis line 115 at a set location. Similarly, the radius line 117 from a second trailing end of the repeat cycle will intersect the axis line 115 at a second set location. The set distance 119 between the first and second locations typically represent an article length 36. The set distance length 119 can be divided into a selected number of increments, as desired. The number of increments should be large enough to provide the desired resolution within the cutting pattern, but there is no upper limit to the number of selected increments. As a practical matter, the number of increments is selected to provide the resolution of cutting desired for the cutting process. In the illustrated arrangement, for example, set distance 119 can be divided into 80 increments of substantially equal length to generate 81 cam points, where the first and 81st cam points are substantially identical and represent the end points of the repeat cycle segment 35 of the cut pattern 32.

From each of the selected incremental length points along the set distance 119, the radius line 117 is swung to intersect the cut pattern segment 35, and the angle between the radius line 117 and the axis line 115 is measured. This procedure can be repeated for each incremental point along set distance 119 to generate a set of profile angles. The profile angles are desirably normalized to produce a corresponding set of "cam points". For example, the profile angles can be normalized by subtracting the first cam point value (in encoder counts) from each of the cam point values so that each repeat cycle of the cut pattern will start with "zero" as the first cam point value. The resultant set of cam points provide a "cam table" which is employed as the data set 50 within the regulating means 48, particularly within the dual-axis card. The data set 50 thereby effectively provides a distinctive "electronic cam" device.

The operation of the cutting system of the invention can also include the following:

1. Positioning the servo arms in their "neutral position"
2. Aligning the output shaft for proper mechanical stopping
3. System-homing/initialization
4. Proper tuning The neutral positioning of the servo arm 54 involves locating the servo arm at approximately the center of the arc through which nozzle 24 is intended to swing during the cutting operation. As the nozzle 24 sweeps through the arc of the cutting path 46 or 47, substantially equal and opposite amounts of torque can be generated during the resultant twisting of the torque tube 60. This arrangement can advantageously minimize the influence of the spring-action of the torque tube on the motor performance.

Aligning the output shaft involves positioning the mechanical stops on the servo output shaft 45 at the proper location relative to the neutral position of the servo arm 54. When properly positioned, the mechanical stops provide the desired limits on the rotational travel of the servo arm.

System Homing involves moving the servo arm 54 and the flag 55 until the home proximity switch sensor detects the edge of the flag. This position is defined as the "home" position, and provides a mechanism for reliably setting the servo arm to a known reference location. The home position can provide a baseline from which the motor can be made to rotate in accordance with the encoder count values corresponding to the desired cam profile.

Tuning is the process of determining the particular "gains" appropriate for a selected cutting operation. The gains are determined experimentally and will depend upon the individual parameters of the cutting system, such as the length of the torque tube 60 and the accelerations needed to generate the selected cut pattern 32. For the example of the illustrated embodiment, the four gains have the following baseline values:

1. Proportional 10500
2. Integral 20
3. Velocity 36
4. Feedforward 325

Figure 8:
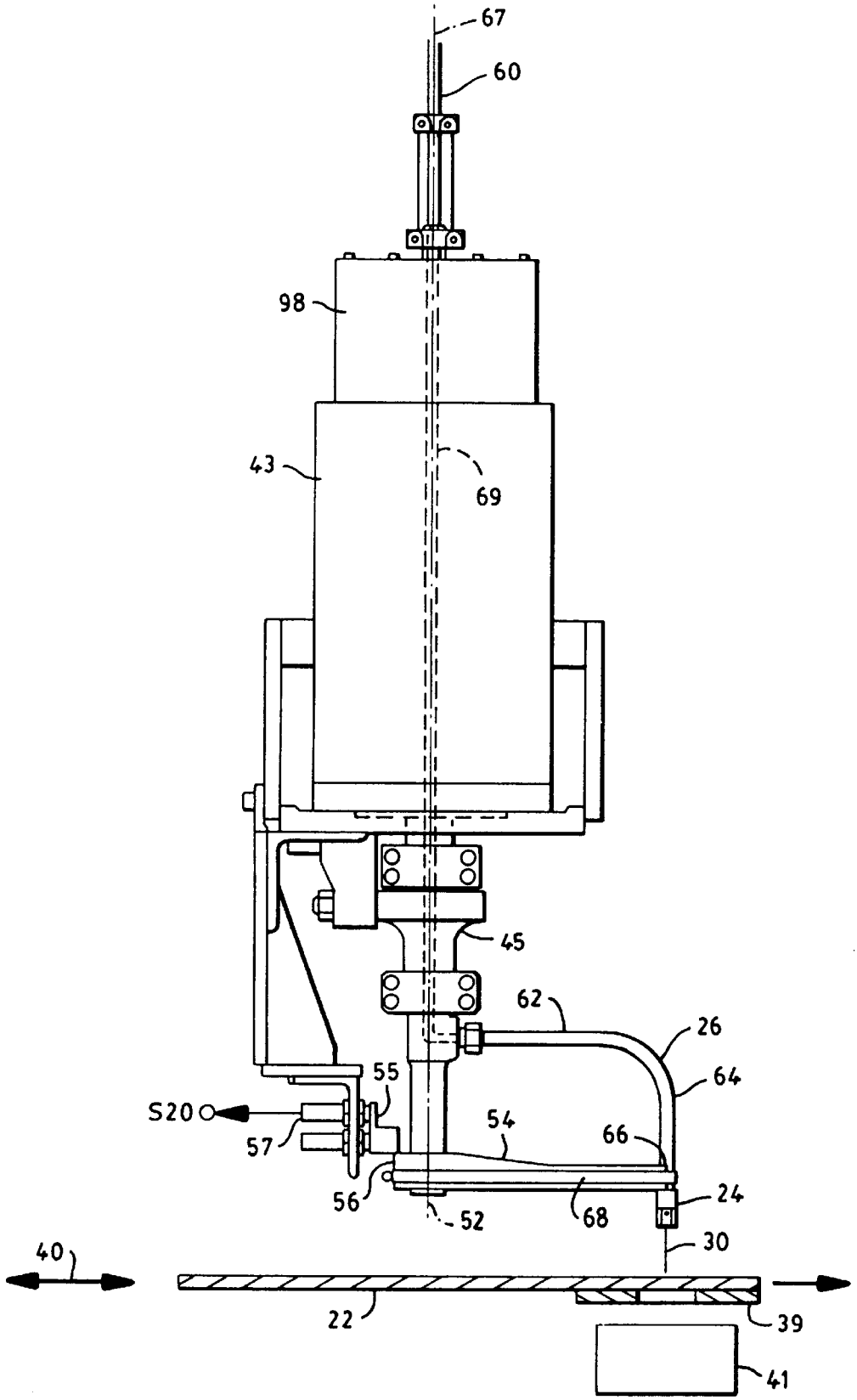
FIG. 8 representatively shows a side view of another cutting system of the invention.
Figure 9:
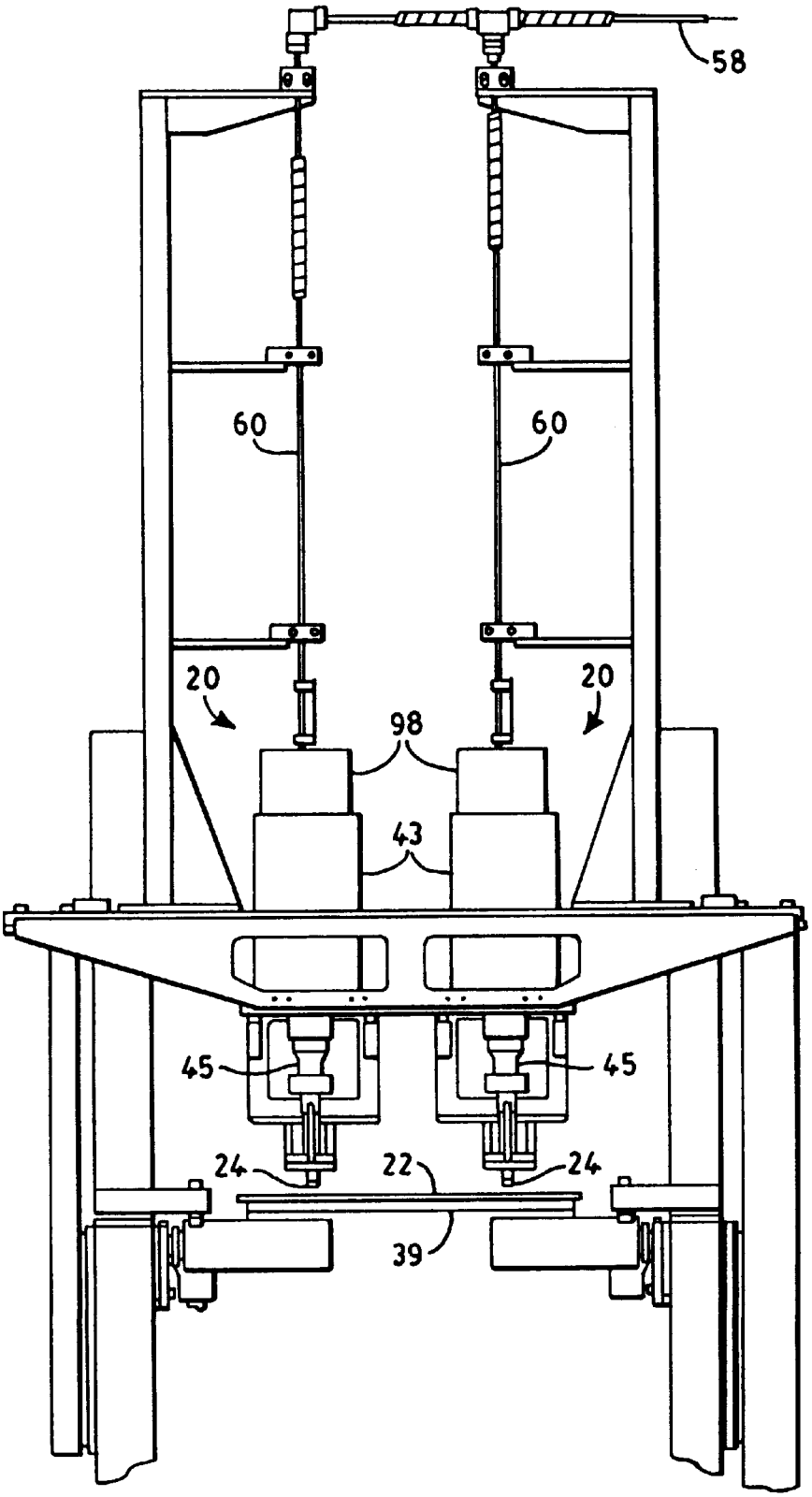
FIG. 9 representatively shows an end view of another device which employs a complementary pair of the cutting systems of the invention to produce a plurality of cut patterns.

With reference to FIGS. 8 and 9, an alternative configuration of the invention can include a servo motor 43 having a generally coaxial passage 69 which Is formed through the motor and along the motor axis 52. More particularly, the passage can extend through the motor shaft. Similarly, the passage 69 can also extend through the motor encoder 98 and can be arranged generally coaxial with the motor encoder. As a result, the passageway 69 allows the transport and movement of the selected fluid through the interior of the actuating servo 44. This construction advantageously permits a positioning of the servo motor and motor encoder with the driven nozzle body and nozzle 24 on the same side of the substrate 22. Such a configuration can reduce the likelihood of undesired interference between the apparatus and the substrate, and can provide greater flexibility with regard to locating and transporting the substrate past the nozzle 24. An example of a suitable servo motor is a Reliance ES20040 motor, which is available from Reliance Electric Company.

In the representatively shown configuration, the portion of the delivery conduit provided by torque tube 60 is operably connected in fluid communication with the passage 69 entering into the actuating servo 44 through the end of the motor encoder 98. For example, the torque tube 60 may be constructed to terminate at the motor encoder, or may be constructed to extend and continue through the passage 69 formed through the encoder shaft. Similarly, the torque tube 60 may be constructed to terminate at the servo motor 43, or may be constructed to extend and continue through the passage 69 formed through the motor shaft.

The motor output shaft 45 is operably configured to deliver the selected fluid to the nozzle body and movable support 26. Suitable fluid passageways are formed in the output shaft to provide an operable fluid communication from the output shaft and into the conduit arm section 62 of the nozzle body. The fluid travels from the arm section 62, through the support section 64 and into the nozzle 24 for delivery onto the substrate 22, similar to the manner previously described. In the shown arrangement, the motor output shaft 45 extends beyond the interconnection between the motor shaft and the conduit arm section 62, and provides a mounting section upon which the servo arm 54 can be secured and configured In a manner similar to that previously described. Optionally, the servo arm 54 may be positioned between the servo motor 43 and the conduit arm section 64. Accordingly, the actuating servo 44 again has a servo axis of rotation 52 which is arranged substantially collinear with the torque axis 67 of the energy storage means provided by the torque tube conduit section 60.

As previously described the regulating means 48 would be operably connected to control the actuating servo 44 by employing a selected, electronically stored data set 50. The data set is configured to move the actuating servo 44 in a selected sequence, and the sequence has a predetermined correspondence with the movement of the substrate 22 to thereby direct the nozzle 24 along the selected delivery path and provide the selected pattern, such as the cut pattern 32, onto the substrate.

Having thus described the invention in rather full detail, it will be readily apparent that various changes and modifications can be made without departing from the spirit of the invention. All of such changes and modifications are contemplated as being within the scope of the invention, as defined by the subjoined claims.

We claim:

1. An apparatus for directing a fluid in a selected pattern onto a moving substrate, said apparatus comprising:

a nozzle connected to a movable support and configured to direct said fluid on said moving substrate;

supplying means for providing said fluid to said nozzle at a pressure which provides for a selected fluid flow rate from said nozzle;

designating means for identifying a plurality of selected article lengths along said substrate;

transporting means for moving said substrate at a predetermined speed along a machine direction past said nozzle during said directing of fluid onto said substrate;

an actuating servo connected to move said nozzle along a selected delivery path; and regulating means connected to control said actuating servo by employing a selected, electronically stored data set which has a sequence of numbers with each number representing a desired motor angle provided for by said actuating servo, said data set configured to move said actuating servo in a selected sequence, and said sequence having a predetermined correspondence with movement positions of said substrate to thereby direct said nozzle along said selected delivery path and provide said selected pattern onto each selected article length of said substrate.

2. An apparatus for cutting a moving substrate, said apparatus comprising:

a cutter nozzle connected to a movable support and configured to direct said fluid on said moving substrate;

supplying means for providing a cutting fluid to said cutter nozzle at a pressure which provides for a fluid flow rate from said cutter nozzle, said fluid flow rate sufficient to cut said substrate in a selected cut pattern;

designating means for identifying a plurality of selected article lengths along said substrate, said article lengths defining a plurality of article segments which are interconnected along a machine direction of said apparatus;

transporting means for moving said substrate at a predetermined speed past said cutter nozzle along said machine direction during said cutting of said substrate;

an actuating servo configured to move said cutter nozzle along a selected cutting path; and regulating means for controlling said actuating servo by employing a selected, electronically stored data set which has a sequence of numbers with each number representing a desired motor angle provided for by said actuating servo, said data set configured to move said actuating servo in a selected sequence, and said sequence having a predetermined correspondence with movement positions of said substrate to thereby direct said cutter nozzle along said selected cutting path and provide said selected cut pattern on each selected article length of said substrate.

3. An apparatus as recited in claim 1, wherein said transporting means is constructed to move said substrate at a speed of at least about 100 ft/min.

4. An apparatus as recited in claim 1, wherein said actuating servo is constructed to provide an angular acceleration of said movable support of at least about 1,000 radian/sec$^2$.

5. An apparatus as recited in claim 4, wherein said actuating servo includes an electro-magnetic motor which rotates an actuator arm connected to said movable support.

6. An apparatus as recited in claim 1, further comprising an energy storage system connected to said movable support to absorb mechanical energy produced by a twisting motion of said nozzle along said directing path.

7. An apparatus as recited in claim 6, wherein said energy storage system comprises a torque tube, and said torque tube is constructed to conduct said fluid to said nozzle.

8. An apparatus as recited in claim 6, wherein said energy storage system comprises a tubing coil, and said tubing coil is constructed to conduct said fluid to said nozzle.

9. An apparatus as recited in claim 7, wherein said actuating servo includes an operational axis of rotation, and said torque tube is substantially aligned with said operational axis of said actuating servo.

10. An apparatus as recited in claim 1, wherein said actuating servo includes a passageway which allows a transport of said fluid through an interior of said actuating servo.

11. An apparatus as recited in claim 1, wherein said designating means includes a line encoder which provides article position data regarding a location of each of said selected lengths along said substrate; and said regulating means includes an actuator encoder which provides actuator data regarding a location of said nozzle, a comparator for comparing said actuator data to a set of path position data which is tabulated in correspondence with distance along said machine direction of each article length, and an output generator for producing a signal which directs a movement of said actuating servo to locate said nozzle in substantial accordance with said path position data.

12. An apparatus as recited in claim 11, further comprising a gearing encoder connected to monitor a position of said substrate to provide for a machine-directional shift in said selected pattern relative to said selected lengths along said substrate.

13. A method for directing a fluid in a selected pattern onto a moving substrate, said method comprising the steps of:

(a) providing a nozzle;

(b) supplying a selected fluid to said nozzle at a pressure which provides for a selected fluid flow rate from said nozzle;

(c) identifying a plurality of selected article lengths along said substrate;

(d) transporting said substrate to move said substrate past said nozzle along a machine direction at a predetermined speed during said directing of fluid onto said substrate;

(e) servo actuating a movement of said nozzle along a selected delivery path; and (f) regulating said servo actuating step (e) in accordance with an electronically stored data set which has a sequence of numbers with each number representing a desired motor angle provided for by said servo actuating step (e), said data set configured to control said servo actuating step (e) in a selected sequence, said sequence having a predetermined correspondence with transporting positions of said substrate to thereby direct said nozzle along said selected delivery path and provide said selected pattern on each selected article length of said substrate.

14. A method for cutting a moving substrate, said method comprising the steps of:

(a) providing a cutter nozzle;

(b) supplying a cutting fluid to said cutter nozzle at a pressure which provides for a fluid flow rate from said cutter nozzle, said fluid flow rate sufficient to cut said substrate in a selected cut pattern;

(c) identifying a plurality of selected article lengths along said substrate, said article lengths defining a plurality of article segments which are interconnected along a machine direction of said substrate;

(d) transporting said substrate to move said article segments past said cutter nozzle along said machine direction at a predetermined speed during said cutting of said substrate;

(e) servo actuating a movement of said cutter nozzle along a selected cutting path; and (f) regulating said servo actuating step (e) in accordance with an electronically stored data set which has a sequence of numbers with each number representing a desired motor angle provided for by said servo actuating step (e), said data set configured to control said servo actuating step (e) in a selected sequence, said sequence having a predetermined correspondence with transporting positions of said substrate to thereby direct said cutter nozzle along said selected cutting path and provide said selected cut pattern on each selected article length of said substrate.

15. A method as recited in claim 13, further comprising the step of providing an energy storage system for absorbing mechanical energy produced by moving said nozzle along said delivery path.

16. A method as recited in claim 15, wherein said energy storage system comprises a torque tube, and said torque tube is constructed to conduct said fluid to said nozzle.

17. A method as recited in claim 15, wherein said energy storage system comprises a tubing coil, and said tubing coil is constructed to conduct said fluid to said nozzle.

18. A method as recited in claim 16, wherein said servo actuating step (e) includes an operational axis of rotation, and said torque tube is substantially aligned with said operational axis of said servo actuating step.

19. A method as recited in claim 13, wherein said identifying step (c) employs a line encoder which provides position data regarding a location of each selected length of said substrate along said machine direction of said substrate; and said regulating step (f) employs an actuator encoder which provides actuator data regarding a location of said nozzle, a comparator for comparing said actuator data to a set of path position data which is tabulated in correspondence with distance along said machine direction of each selected length along said substrate, and an output generator for producing a signal which directs a movement of said actuating servo to locate said nozzle in substantial accordance with said path position data.

20. A method as recited in claim 19, further comprising a gearing encoder configured to provide a machine-directional shift in said selected pattern relative to said selected lengths along said substrate.

21. A method as recited in claim 19, wherein said identifying step (c) provides marker data which correspond to the position and presence of an individual article segment of said substrate.

22. A method as recited in claim 13, wherein said servo actuating step (e) moves said movable support with a rotating actuator arm.

23. A method as recited in claim 13, wherein said servo actuating step (e) provides said nozzle with an angular acceleration of at least about 1,000 radian/sec$^2$.

24. A method as recited in claim 13, further including an assembling of additional components to said substrate to form an interconnected plurality of article segments, and a separating of said substrate at said article segments to form individual articles.

25. A method as recited in claim 13, wherein said each number is expressed in terms of a corresponding number of encoder counts provided by a motor encoder.

26. An apparatus as recited in claim 1, further including a mechanism for assembling additional components to said substrate to form an interconnected plurality of article segments, and for separating said substrate at said article segments to form individual articles.

27. An apparatus as recited in claim 1, wherein said each number is expressed in terms of a corresponding number of encoder counts provided by a motor encoder connected to said actuating servo.

28. An apparatus as recited in claim 11, wherein said designating means also provides marker data which correspond to the position and presence of individual article segments of said substrate.

* * * * *